United States Patent [19]

Piramoon

[11] 4,449,966

[45] May 22, 1984

[54] CENTRIFUGE ROTOR BALANCING BOSSES

[75] Inventor: Alireza Piramoon, Santa Clara, Calif.

[73] Assignee: Beckman Instruments, Inc., Fullerton, Calif.

[21] Appl. No.: 399,166

[22] Filed: Jul. 19, 1982

[51] Int. Cl.[3] ..... B04B 5/02; B04B 9/14

[52] U.S. Cl. ..... 494/20; 494/82

[58] Field of Search ..... 494/82, 84, 85, 7, 16, 494/20, 81

[56] References Cited

U.S. PATENT DOCUMENTS 1,438,768 12/1922 Lapham .

3,762,635 10/1973 Hankey ..... 233/23 A 3,834,613 9/1974 Hankey ..... 233/23 A

*Primary Examiner*—Robert W. Jenkins

*Attorney, Agent, or Firm*—R. J. Steinmeyer; F. L. Mehlhoff; W. H. May

[57] ABSTRACT

Balancing bosses integrally forged in a centrifuge rotor. The plurality of balancing bosses in the rotor establish noncritical areas in the rotor for machining to accomplish the precise balancing necessary for high speed ultracentrifugation. The balancing bosses are located away from the high stress periphery of the rotor so that machining a portion of the bosses for balancing purposes will not degrade the integral strength of the rotor.

3 Claims, 3 Drawing Figures

CENTRIFUGE ROTOR BALANCING BOSSES

BACKGROUND OF THE INVENTION

The present invention is directed to balancing centrifuge rotors and, more particularly, is directed to an improved rotor structure to permit balancing without affecting the strength of the rotor.

Critical to the successful operation of a high speed ultracentrifuge is the precise balance in the rotor for its rotation about its spin axis. When a rotor operates at a speed of several thousand r.p.m.'s, any inherent imbalance in the rotor will result in unstable operation. The consequences of unstable operation can be quite serious. The rotor may become detached from its drive spindle, causing damage not only to the rotor, but also to the centrifuge machine in which it is placed. Furthermore, valuable samples carried in the rotor may be lost.

One method of making centrifuge rotors is to forge the rotor out of a high strength metal and then machine all or part of the rotor to establish the proper balance. Because machining is very expensive, any reduction in amount of machining necessary on a rotor is greatly desirable. Unfortunately, in most forged surfaces, there are significant tolerance variations which would create unacceptable imbalance in a rotor. Typically the outer surface of the rotor is machined to provide the desired balance in the rotor. However, in high speed ultracentrifugation the highest stress in the rotor is at the maximum diameter of the rotor. In other words, at the extreme periphery where the distance from the spin axis is the greatest will be the location of the most stress in the rotor. It is, therefore, undesirable to remove material from the exterior of the rotor, since it may affect the integral strength of the rotor during high speed ultracentrifugation. This is especially true with respect to rotors designed for a minimum of machining.

In the initial design of the rotor the dimensions of the rotor body with respect to the cavities or recesses for receipt of the containers having the fluid samples are precisely defined to a close tolerance. This tolerance is important with respect to not using any more material than is necessary to provide the requisite strength to support the fluid samples. Otherwise, if too great a mass is utilized in the design of the rotor, its maximum safe speed is reduced for the same size drive system. Also, the size of the rotor is generally limited by its interface with the rotor chamber in the centrifuge.

In certain particular rotors, which are sometimes referred to as swinging bucket rotors, a plurality of arms extend radially outward from a central post to which is connected the drive spindle. The outer extremeties of the arms are connected to a support ring. Swinging bucket containers are positioned between the arms and, during centrifugation, the buckets will swing from a vertical position to a horizontal position. Furthermore, the buckets are designed to seat on the interior surface of this outer ring. Consequently, this outer ring provides essentially all the support to the swinging buckets during centrifugation. Thus, it is undesirable to machine any of the surface of this outer ring, because it may affect its integral strength during centrifugation.

As stated previously, in the initial design of any rotor the mass and dimensions of the rotor are carefully formulated to obtain the optimum support while limiting the amount of stress experienced by the rotor for a given speed. In any event, there are particular areas in the rotor that are exposed to extremely high stress.

These high stress areas are typically at the outer extremity of the rotor. The state of the art of forging is limited in the capability of making a perfectly balanced rotor. Therefore, some machining will always be required to obtain the precise balance needed for high speed centrifugation. The achievement of the perfect balance, however, cannot be accomplished at the sacrifice of the requisite strength in the rotor to withstand the high stresses during centrifugation.

SUMMARY OF THE INVENTION

The present invention incorporates a plurality of balancing bosses that are integrally forged into a centrifuge rotor. These balancing bosses are located away from the high stress area in the rotor. As a result, it is possible through correctly formulated balancing calculations to machine these balancing bosses precisely to establish the requisite balance in the rotor.

Since the balancing bosses are located between the spin axis of the rotor and its exterior periphery, they are not positioned in the high stress area of the rotor and, therefore, any machining or removal of material from these bosses does not affect the strength of the rotor. Furthermore, by placing the balancing bosses at particular locations on the rotor around the spin axis, it is possible to calculate precisely how much material needs to be removed from any or all of the balancing bosses to provide the critical balancing. This calculation eliminates prior trial-and-error approaches which have been utilized.

DETAILED DESCRIPTION OF THE INVENTION

Figure 1:
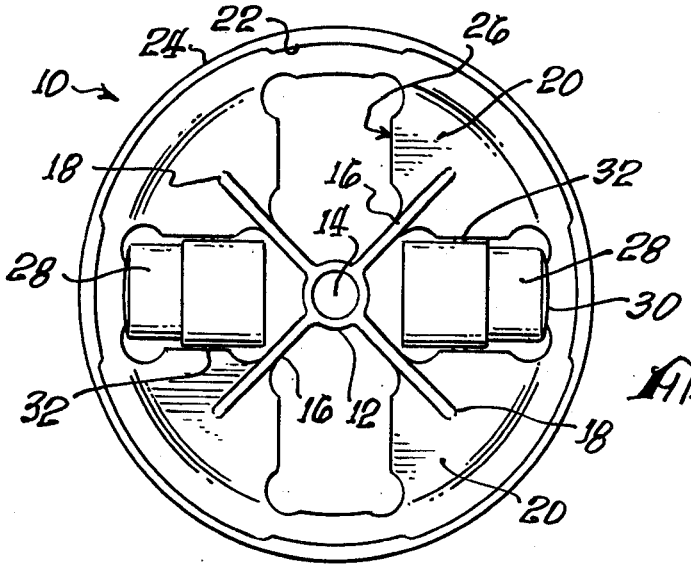
FIG. 1 is a top view of a swinging bucket type of rotor showing the bucket containers in the position assumed during centrifugation.

A swinging bucket type rotor 10 is shown in FIG. 1 having a central hub or post 12 which is aligned with the spin axis 14 of the rotor. Extending radially outward from the central hub 12 are a plurality of arms or spokes 16. The extreme ends 18 of the arms 16 are each integrally connected to a separate mounting flange 20. Each of the mounting flanges 20 connect the radial arms 16 to the interior surface 22 of an outer support ring 24. Preferably, the rotor 10 is made of forged aluminum which requires some limited machining. Mounted in the open or yoke areas 26 between the adjacent radiating arms 16 and adjacent mounting flanges 20 are swinging buckets 28. For purposes of clarity, only two swinging buckets 28 are shown in FIG. 1 and are positioned in the horizontal orientation that they would assume during high speed ultracentrifugation. In this type of position, the bottom 30 of each of the buckets may be designed to contact the interior surface 22 of the outer support ring 24. Consequently, the buckets would be supported not only by the pivot pins 32 which connect the buckets to the mounting flanges 20, but also by the outer support ring 24. Located in each of the swinging buckets 28 are fluid samples to be centrifugated. The rotor could operate with either two buckets, as shown in FIG. 1, or with four buckets.

During the operation of the rotor, it is important that it be in correct balance so that there will be no instability in the operation. Otherwise, imbalance could lead to possible disengagement of the rotor from its drive shaft and cause the rotor to thrash within the centrifuge machine, damaging not only the rotor, but also the machine. In order to ensure proper balance, it is necessary for the operator, when placing the fluid samples in the swinging containers 28, to place the proper balanced amount of fluid sample in each of the buckets. However, one aspect of rotor balance which cannot be controlled by the operator is in the design and manufacture of the rotor itself. In a forged rotor, it is necessary to implement some type of machining to the rotor to create the necessary balance.

Figure 2:
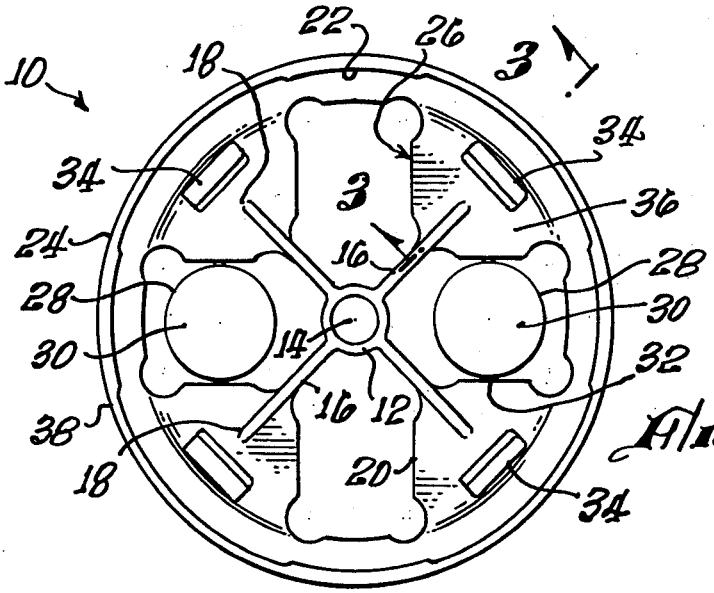
FIG. 2 is a bottom view of the rotor shown in FIG. 1 exhibiting the balancing bosses of the present invention.

In FIG. 2, the bottom of the rotor 10 is shown having a plurality of balancing bosses 34 located on each of the bottom surfaces 36 of the mounting flanges 20. When the rotor is forged, the balancing bosses 34 are integrally formed and project above the surface 36 of the mounting flanges 20. As shown in FIG. 2, the balancing bosses 34 are oriented at 90° intervals around the spin axis 14 of the rotor. Using proper mathematical calculations, one can determine exactly how much of one, two, three, or all of the balancing bosses need to be machined to create the necessary balance in the rotor. Since the balancing bosses 34 are integrally formed in the rotor as an extra amount of material, removal of the material for balancing purposes will not affect the strength or integrity of the rotor.

During high speed ultracentrifugation, the highest stress area will be at the periphery 38 of the outer ring 24. Consequently, essentially the entire outer ring 24 will be subjected to the highest stress in the rotor during centrifugation. Therefore, it is not desirable to machine material off of the outer ring 24, because it may affect the integral strength of the ring during centrifugation. The location of the balancing bosses 34 at a position inward from the outer ring 24 toward the spin axis 14 places them in a location out of the high stress area in the rotor. Consequently, the removal of material from these bosses will not affect the strength of the rotor.

In addition to the fact that the integrity of the rotor is not affected by machining of the balancing bosses, the use of the balancing bosses provides an efficient and precise manner in which to calculate the necessary material to be removed to balance the rotor. Through mathematical calculations, this can be precisely determined and eliminates a trial-and-error method of attempting to balance a rotor.

Figure 3:
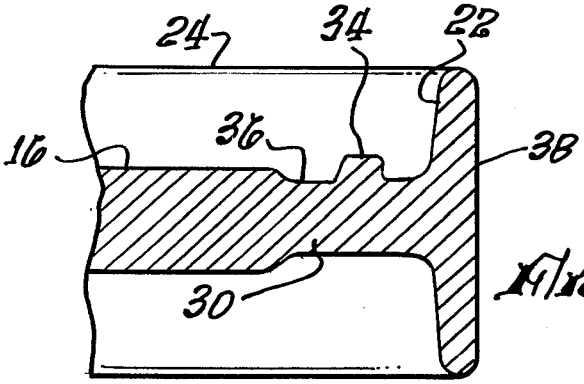
FIG. 3 is a sectional view taken along the lines 3—3 in FIG. 2.

As shown in FIG. 3, the balancing boss 34 is a slight projection above the bottom surface 36 of the mounting flange 20 in the rotor. With the slight removal of material from the balancing boss, it is possible to provide the necessary balance to the rotor during high speed ultracentrifugation. It is envisioned that the amount of projection of the balancing boss 34 is maintained at only the amount necessary to provide anticipated machining for balancing.

Although the drawings reveal a swinging bucket type of rotor, it is envisioned that other types of forged rotors could utilize the concept of projecting balancing bosses located away from high stress areas to enhance precise balancing without affecting rotor strength. The use of the balancing bosses provides a precise location to accomplish the machining necessary for the proper imbalance in the rotor. Consequently, it is envisioned that the concept of the balancing bosses could be utilized in other types of centrifuge rotors and remain within the scope of the present invention. Further, the location of the balancing bosses on the rotor may vary from the positions shown in the drawings but still remain within the scope of the present invention.

What is claimed is:

1. A centrifuge rotor comprising:

a central post;

a plurality of arms extending out from said central post;

a support ring connected to the outer ends of said arms, said ring being the highest stress area in said rotor during centrifugation means within said rotor for holding fluid samples; and a plurality of projecting bosses located on said arms, said bosses being selectably machined to establish perfect balance of said rotor when it rotates on said spin axis.

2. A centrifuge rotor as defined in claim 2, wherein said holding means comprises a plurality of containers pivotally mounted between adjacent arms, said containers contacting and being supported by said support ring during centrifugation.

3. A centrifuge rotor comprising:

a central post aligned with the spin axis of the rotor;

a plurality of support arms extending radially outward from said central post;

a support ring surrounding and attached to said arms, said ring with said arms forming recesses for receipt of fluid sample containers; and a plurality of selectively machinable bosses integrally formed in said rotor between said ring and said central post, the size of said bosses determining the proper balance of said rotor during centrifugation.

* * * * *